United States Patent [19]

Ng

[11] Patent Number: 4,534,474

[45] Date of Patent: Aug. 13, 1985

[54] COLLAPSIBLE KITCHEN UTENSIL HOLDER

[75] Inventor: Min-Hing Ng, Kowloon, Hong Kong

[73] Assignee: Concord Tool and Machine Company, Hong Kong, Hong Kong

[21] Appl. No.: 430,279

[22] Filed: Sep. 30, 1982

[51] Int. Cl.[3] ..... A47F 5/02; A47F 7/00

[52] U.S. Cl. ..... 211/70; 206/501; 206/514; 211/70.7; 211/129; 220/8; 220/23.86; 248/37.3; D7/74

[58] Field of Search ..... D7/72, 73, 74; 211/189, 211/194, 163, 70, 70.6, 70.7, 78, 128, 129; 248/37.3; 206/514, 501; 220/8, 23.83, 23.86

[56] References Cited

U.S. PATENT DOCUMENTS 4,305,511 12/1981 Denholtz ..... 211/70

OTHER PUBLICATIONS

Photographs of the Metro Organizer.

Photographs of the Home Turntable Organizer.

*Primary Examiner*—Robert W. Gibson, Jr.

[57] ABSTRACT

A utensil holder which includes three separate annular sections of different diameters, can be assembled in interlocking superposed relationship as a one-tier holder, a two-tier holder or a three-tier holder. For shipping purposes, all three sections nest one within the other to provide an assembly which is the size of the largest section.

10 Claims, 8 Drawing Figures

COLLAPSIBLE KITCHEN UTENSIL HOLDER

BACKGROUND AND BRIEF SUMMARY OF THE INVENTION

This invention relates generally to kitchen utensil holders, and more particularly to a novel multi-tiered holder which is collapsible for convenient packaging, shipping, storage and merchandising.

There are many items of utilitarian nature which are lightweight and relatively inexpensive to make but which are so large and bulky that they cannot be effectively and economically shipped and merchandised. Thus, the size and bulk of many items are often such that the cost of the packaging for the items exceeds their value to the customer and/or the cost of shipping them is economically prohibitive due to the large space they occupy. Furthermore, many such items when packaged and sent out for retail sales, occupy so much costly shelf or counter space that retail merchants cannot afford to stock or handle them.

It is a well recognized principal in the merchandising field that most utilitarian items, and particularly relatively inexpensive kitchen utensils, are marketable within a rather narrow price range, and that the prices which can be obtained for them must obviously include the costs for packaging, shipping and handling, as well as the cost of manufacturing. If the foregoing non-manufacturing costs are excessive, such items might not be salable because the customers will purchase a less expensive item which will perform substantially the same function.

In past years, tool and utensil holders which have been available have been unnecessarily cumbersome and relatively unattractive. Representative patents showing such holders include Pat. No. 226,645, Pat. No. 3,227,283 and Pat. No. 3,489,289.

In recent years, manufacturers have sought to commercially exploit kitchen utensil holders which are injection molded plastic items, and which are light in weight, aesthetically attractive and functionally convenient to use. While such plastic utensil holders are relatively inexpensive to make, the cost of packaging and shipping some of them has proven to be excessive and to so reduce profits that their commercial success has been marginal, at least. The above, coupled with the fact that the large packaged items require the use of excessive, costly shelf space for retail exploitation thereof, has made them items which most retailers are extremely reluctant to handle. Representative of this last-mentioned group is the utensil storage device which is the subject matter of Pat. No. 4,305,511.

With the foregoing limitations and deficiencies of known devices in mind, it is an object of the present invention to provide a novel, inexpensive, multi-tiered kitchen utensil holder which is sectional and constructed in such a manner that the sections can be disengaged and positioned one within the other, to greatly reduce the size of the holder when it is not in use, whereby the cost of packaging, storing, shipping and handling to effect commercial exploitations thereof is materially reduced.

A further object of the invention is to provide a novel, multi-tiered kitchen utensil holder comprising two or more axially aligned telescopically engaged sections with utensil receiving and holding means formed therein, which sections are engageable and disengageable between operative and collapsed positions, whereby the cubic volume metric space effectively occupied by the holder when it is in the collapsed or stored position is less than one-half the cubic volume metric space occupied by the holder when it is in the extended or fully assembled position.

Yet another object is to provide a novel kitchen utensil holder which can be used in the form of a single-tier, two-tiered, or three-tiered holder.

An additional object is to provide such a multi-tiered holder which can be easily and quickly changed between a stored or collapsed position and any one of a single-tiered, two-tiered or three-tiered operative or fully assembled position.

Another object is to provide a utensil holder of the type described, which includes easily operable and durable mean to effectively couple the sections or tiers together and to establish a strong utilitarian assembly.

The foregoing and other objects and advantages of the invention will be apparent and fully understood from the following detailed description of one typical preferred embodiment of the invention, throughout which description reference is made to the accompanying drawings.

DETAILED DESCRIPTION OF THE INVENTION

Figure 1:
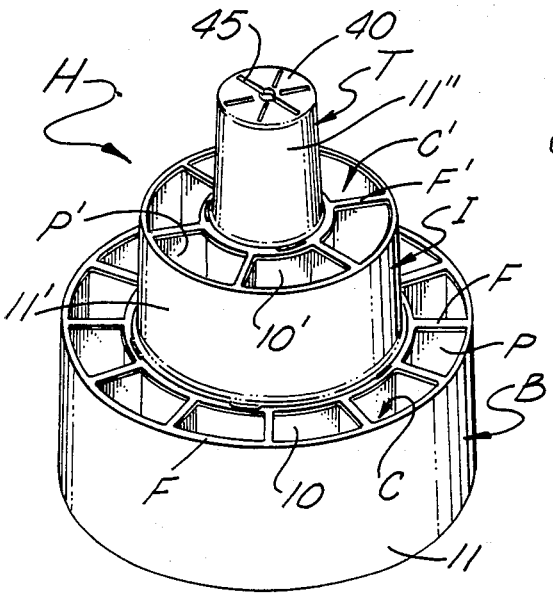
FIG. 1 is an isometric view of a utensil holder embodying the teachings of the present invention shown in its fully assembled or operative position, utilizing all three sections.
Figure 3:
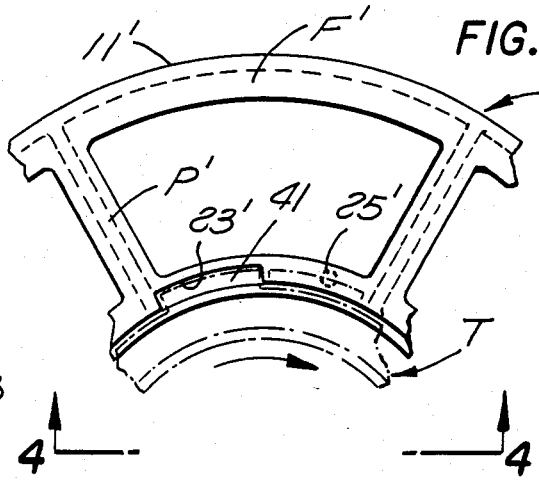
FIG. 3 is an enlarged, fragmentary plan view of the intermediate section shown in FIG. 1, with a portion of the top section shown in phantom lines and positioned prior to rotating the top section in the clockwise direction to engage the bayonet-type interlocking means.

FIG. 1 of the drawings shows a preferred embodiment of the novel kitchen utensil holder H in the fully assembled or operative position, utilizing all three tiers or sections.

As shown, the holder H includes a vertically extending cylindrical lower base section B; a vertically extending, cylindrical, intermediate section I smaller in diameter than and projecting upwardly from the base section B concentrically therewith; and a vertically extending, cylindrical, top section T smaller in diameter than the intermediate section I and projecting upwardly from the section I concentrically therewith.

The base section B includes an annular, unitary injection molded plastic part containing concentric, radially spaced, cylindrical, vertically extending inner and outer walls 10 and 11, respectively, and a plurality of vertical, circumferentially spaced, radially extending partitions P joined integrally with and extending between the walls 10 and 11, thereby defining an outer series of vertically extending, utensil receiving compartments C.

As presently constructed, the base section B is approximately 9½" in outside diameter, about 5¾" in inside diameter, and about 4" in vertical dimension. It is provided with thirteen partitions P defining 12 compartments C.

In the preferred form of the invention, the upper edges of the walls 10 and 11 and of the partitions P are provided with webs and flanges F which extend about the open tops of the compartments C and impart to the top of the section B an attractive and finished appearance.

Figure 7:
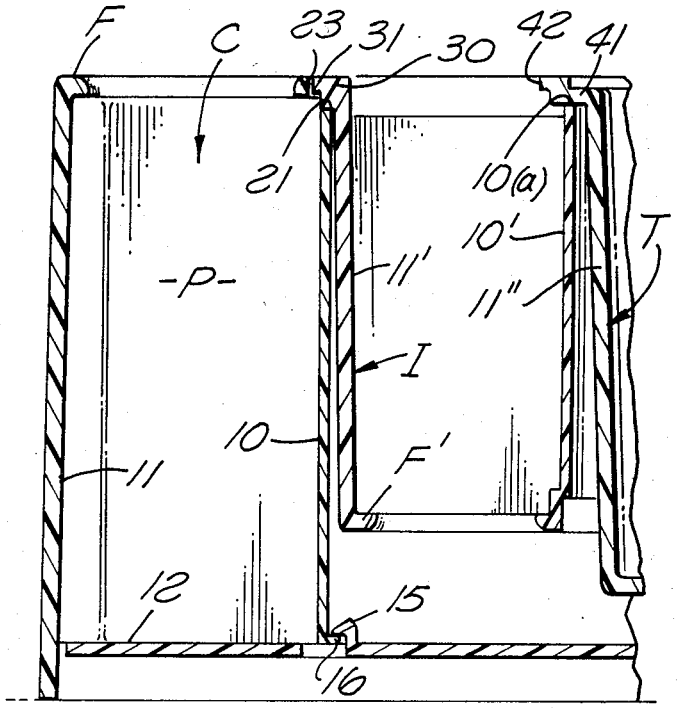
FIG. 7 is an enlarged, fragmentary, vertical sectional view of the assembly with all three sections in their collapsed or stored position, taken substantially as indicated by line 7—7 on FIG. 6.

The lower edge of the inner wall 10 terminates a short distance above the bottom plane of the base section B which is defined by the lower edge of the outer wall 11 (FIG. 7).

A horizontal, molded plastic disc-like bottom wall 12 (FIG. 7) is positioned in the lower end of the base section B within the outer wall 11 and adjacent the lower edge of the inner wall 10. The bottom wall 12, which closes the lower ends of the compartments C, is held in position by a plurality of circumferentially spaced latches or pawls 15, formed on the bottom wall 12 and engaged with an inwardly projecting retaining lip 16 formed on the lower edge of the inner wall 10 (FIG. 7).

In practice, the wall 12 can have attached to it, an anti-friction bearing structure (not shown) to rotatably support the holder above a flat surface.

Figure 4:
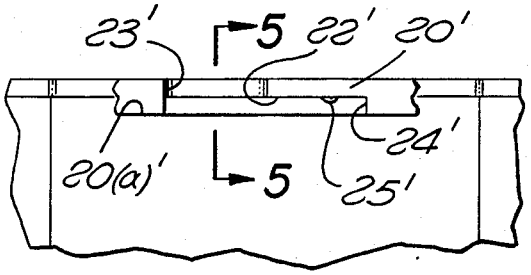
FIG. 4 is a fragmentary, vertical view taken substantially as indicated by line 4—4 on FIG. 3.
Figure 2:
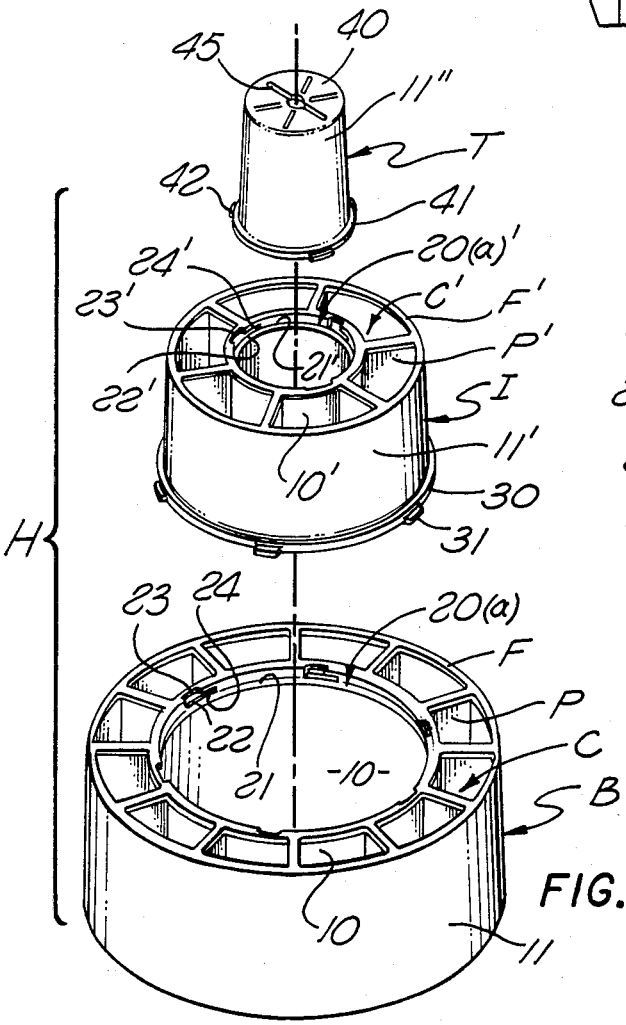
FIG. 2 is an exploded view of the structure shown in FIG. 1, illustrating the manner in which the sections are interlocked in the operative position.

The upper edge of the inner wall 10 of the base section B is formed with a radially outwardly offset rim or flange portion 20 (FIG. 2) defining a radially inwardly and upwardly opening annular recess 20(*a*) with an upwardly facing stop shoulder 21. The rim portion 20 is formed with a plurality (6) of circumferentially spaced bayonet slots 22. The bayonet slots 22 are elongate, horizontal, circumferentially extending slots formed in the rim portion 20 adjacent the stop shoulder 21 and have vertically extending radially and upwardly opening gates 23 at one end thereof, and a vertically extending edge or shoulder 24 at the other end. A small protuberance or detent 25 is provided in each bayonet slot 22 on the underside of the flange 20 adjacent the shoulder 24, for a purpose to appear. This detent is best shown in FIG. 4 at 25' and is also contained on the intermediate section I, as will now be described.

The intermediate section I of the holder H is generally similar in construction to the base section B, but it does not contain a bottom wall and is smaller in diameter so that it fits within the base section B.

Figure 5:
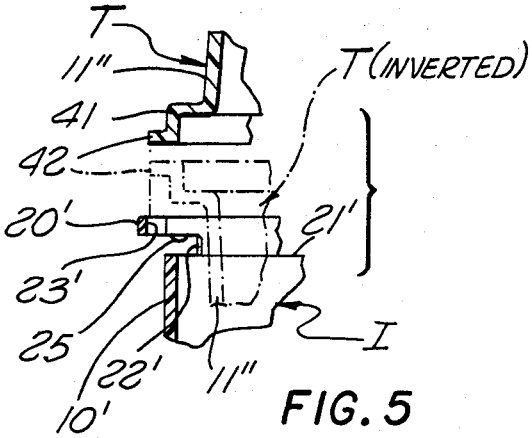
FIG. 5 is a fragmentary, vertical, sectional view taken substantially as indicated by line 5—5 on FIG. 4.

Thus, the intermediate section I has radially spaced, cylindrical, vertically extending inner and outer walls 10' and 11', respectively, partitions P' defining compartments C', and can be provided with finishing ribs and flanges F', as desired. The upper end of the inner wall 10' of the section I, as in the section B, is formed with an offset rim portion 20' (FIGS. 4 and 5), defining an upperwardly extending annular recess 20(*a*)', with an upwardly facing stop shoulder 21' and in which is established a series of circumferentially extending bayonet slots 22' with vertically opening gates 23', shoulders 24', and detents 25'.

The outer wall 11' of the section I is approximately 5½" in diameter, the inner wall 10' is about 2½" in diameter, and the vertical measurement of the section I is about 3".

Accordingly, as shown in FIG. 7 and as will be discussed more fully hereinafter, in the stored or single tier usage, the section I can be slidably or telescopically positioned in the center of the annular base section B, within the wall 10 thereof. Due to the smaller outside diameter of the section I, it has but three bayonet slots 22', and six partitions P' defining five compartments C'.

The lower edge of the outer wall 11' of the section I (FIG. 2) is provided with a radially outwardly projecting annular flange 30 of a diameter to be slidably received in the recess 20(*a*) in the offset rim portion 20 of the section B, and which seats on the stop shoulder 21 of the section B when the construction is in the assembled two or three-tiered position.

The flange 30 is provided with six circumferentially spaced, radially outwardly projecting bayonet lugs 31. The lugs 31 are engageable through the gates 23 of the bayonet slots 22 in the section B and are movable circumferentially in the clockwise direction in the slots 21 to releasably couple the lower end of the section I in and with the upper end of the section B, concentrically therewith (FIG. 1). Thus, when the lugs 31 are rotated in the clockwise direction, the upper surfaces thereof frictionally engage the detents 25, which relasably maintain the section I coupled with the section B.

Figure 6:
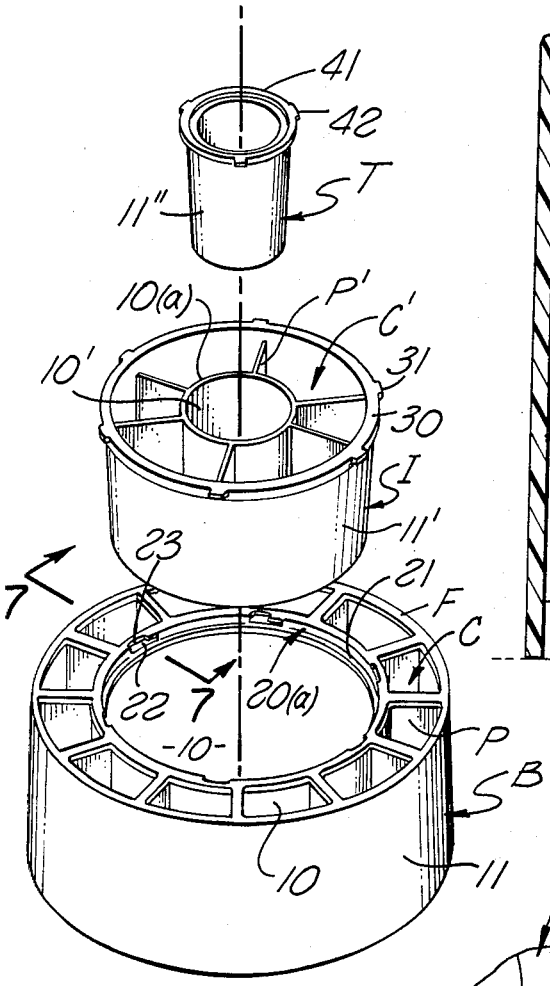
FIG. 6 is an exploded view similar to FIG. 2, but with the intermediate and top tiers or sections in an inverted position to illustrate the manner in which the sections "nest" in the stored or collapsed position.

When the section I is uncoupled from the section B (as by rotating the section in the counterclockwise direction) and is inverted as shown in FIG. 6 of the drawings, it is slidably engageable down and into the section B concentric therewith, as shown in FIG. 7 of the drawings. When thus engaged in the section B, the flange 30 of the section I seats on the shoulder 21 and the lugs 31 are received within the gates 23 of the bayonet slots in the section B to fill the gates and establish a flat and uninterruped top surface about the line of joinder between the sections B and I.

With the above relationship of the various parts, it will be apparent that the section I can be put to utilitarian use in its upright or extended position shown in FIG. 1 of the drawings, or it can be used in the inverted or stored position. Thus, in the upright position shown in FIG. 1 the section I functions as the second tier in a two or three tier assembly and in the inverted position shown in FIGS. 6, 7 and 8, it provides a series of inner utensil-receiving compartments C' or it nests within the base section B for shipping purposes.

The top section T, like the sections B and I, is a relatively inexpensive and easy to make injection molded plastic part. It is cup-like in configuration with a cylindrical outer wall 11", a top or end wall 40, and a lower, radially outwardly projecting flange 41 about the lower rim of the wall 11" and on which is formed a plurality (3) of circumferentially spaced, radially outwardly projecting bayonet lugs 42.

The outer diameter of the flange 41 is of a size to be slidably received in the recess 20(*a*)' and to engage the offset rim portion 20' of the section I with its flange 41 and its lugs 42 engaged in and/or through the gates 23' and the slots 22' of the section I, in the same manner that like related parts of the sections B and I are engaged with each other. As shown in the drawings, the end or top wall 40 of the top section T can be formed with a series of circumferentially spaced, radially extending through-slots 45, in and through which the blades of knives can be slidably engaged and retained. The thus assembled, three-tier arrangement is shown in FIG. 1.

Figure 8:
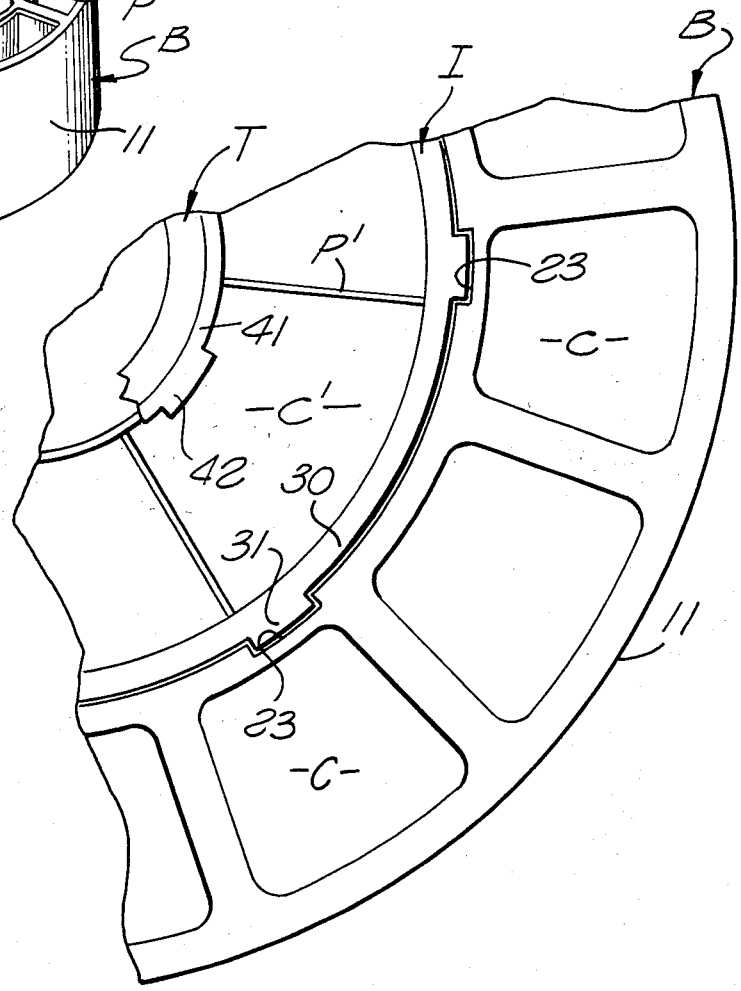
FIG. 8 is an enlarged, fragmentary, top plan view of the holder with the three sections in the collapsed or stored position.

The section T is smaller in outside diameter than the diameter of the inner wall 10' of the section I, so that when it is inverted as shown in FIGS. 6, 7 and 8, it can be slidably engaged down and into the interior of the section I, with the flange 41 thereof seated on the lower edge 10(*a*) of the inner wall 10' of the section I.

It will be noted that when the sections are in the so-called stored or shipping relationship shown in FIGS. 7 and 8, the holder also functions as a single tiered unit with two sets of compartments C and C' and with an inner cup-like receptacle provided by the top section T.

If the holder were to be formed or assembled in a three tiered arrangement, such as shown by the holder in Pat. No. 4,305,511, i.e. so that it could not be readily disassembled for shipping purposes, its outer dimensions would be approximately 10" by 10", thereby requiring a rectangular shaped shipping carton which would occupy one thousand cubic inches.

On the other hand, when the sections T and I of the subject invention are inverted and positioned within their related sections I and B, the vertical height of the assembly is only four inches, thereby requiring a rectangular shaped shipping carton which occupies only four hundred cubic inches, i.e. forty percent of the space occupied by a similar three-tiered holder.

While the bayonet type of coupling means provided to releasably couple the sections B, I and T together in their assembled relationship is preferred, and is more effective than other types of coupling means, it is to be understood that other types of coupling means could be used in place thereof without departing from the broader spirit of the invention.

It is also to be understood that the inner and outer walls and the radially extending partitions of the base section B and the intermediate section I could have double walls in place of the single-wall construction which is shown and described herein, and which is preferred because of less weight.

Thus, it will be apparent that there has been provided a novel collapsible kitchen utensil holder, which fullfills all of the objects and advantages sought therefor.

In particular, in the fully assembled or extended position, there is provided a three-tiered holder which has twelve compartments in the base section B, six compartments in the intermediate section I, and a knife holder in the top section T. In this arrangement, the lugs on the intermediate section I and on the top section T are firmly engaged in their respective bayonet slots, thereby providing a strong and rugged assembly.

If the section T is inverted, there is provided a two-tier utensil holder, with the section T functioning as a cup-like compartment. In this arrangement, the lugs 42 of the section T fully occupy the gates 23' of the section I, thereby providing a smooth, finished appearance for the upper surface of the section I.

To provide a single-tier arrangement, the section T is removed, and the intermediate section I is inverted, with the lugs 31 of the section I occupying the gates 23 of the base section B, to again provide a smooth and finished appearing upper surface with twelve outer compartments, six inner compartments and a central cup like compartment.

For shipping purposes, the intermediate section I is positioned within the base section B in the aforementioned inverted position, with the lugs 31 being received in the gates 23, to provide a substantially flat upper surface, and the top section T is inserted in the center of the intermediate section I in the inverted position. Because the partitions P' of the section I are slightly recessed, the flange 41 and lugs 42 of the section T are substantially co-planer with the upper surface of the base section B, thereby providing a telescopically arranged group of three sections which have a combined heighth which is the same as the heighth of the base section B. Obviously, this provides a compact assembly which occupies a minimum amount of space for shipping and display purposes.

Having described only one typical preferred embodiment of the invention, I do not intend to be limited to the specific details described herein, but desire to reserve to myself any modifications and/or variations which might appear to those skilled in the art and which fall within the scope of the following claims.

I claim:

1. A multi-sectional utensil holder interchangeable between a stored position and an operative position, comprising:

a base section having concentric, annular, radially spaced inner and outer walls of predetermined diameters, with circumferentially spaced, radially extending partitions therebetween to provide a plurality of storage compartments, said walls having top and bottom edges, the top edges of the inner and outer walls being generally in a co-planer relationship;

an intermediate section having concentric, annular, radially spaced outer and inner walls of predetermined diameters, with circumferentially spaced, radially extending partitions therebetween to provide a plurality of storage compartments, said walls having upper and lower edges, the upper edges of the inner and outer walls being generally in a co-planer relationship;

the vertical dimension of the outer wall of the intermediate section being less than the vertical dimension of the inner wall of the base section, and the diameter of the outer wall of the intermediate section being less than the diameter of the inner wall of the base section, whereby the intermediate section in the inverted position is nested within the confines of the inner wall of the base section for shipping purposes; and interengageable, releasable coupling means adjacent the lower edge of the outer wall of the intermediate section and adjacent the top edge of the inner wall of the base section, whereby the intermediate section is positioned on and releasably coupled with the base section to provide a two-tier utensil holder.

2. A multi-sectional utensil holder as described in claim 1, in which the coupling means includes a plurality of circumferentially spaced, radially extending projections adjacent the lower edge of the outer wall of the intermediate section, and a plurality of circumferentially spaced related recesses adjacent the top edge of the inner wall of the base section for receiving the projections.

3. A multi-sectional utensil holder as described in claim 2, in which the projections are generally of the same shape and size as the related recesses.

4. A multi-sectional utensil holder as described in claim 2, in which the coupling means on the base section includes slots adjacent to and in communication with the recesses for receiving the projections of the intermediate section when the intermediate section is positioned on top of the base section with the projections in the recesses and partially rotated relative thereto.

5. A multi-sectional utensil holder as described in claim 4, in which the coupling means includes stop means for limiting the partial rotation of the intermediate section relative to the base section.

6. A multi-sectional utensil holder as described in claim 4, in which the slots of the base section contain detent means for releasably maintaining the intermediate section in the partially rotated coupled position.

7. A multi-sectional utensil holder as described in claim 1, which further includes:

a top section which is cup-like in configuration with an end wall, a side wall which has a lower edge, and an annular open end of a predetermined diameter; and interengageable, releasable coupling means adjacent the lower edge of the side wall of the top section and adjacent the upper edge of the inner wall of the intermediate section, whereby the top section is positioned on and releasably coupled with the intermediate member to provide a three-tier utensil holder.

8. A multi-section utensil holder as described in claim 7, in which the coupling means includes a plurality of circumferentially spaced, radially extending projections adjacent the lower edge of the side wall of the top section, and a plurality of circumferentially spaced related recesses adjacent the upper edge of the inner wall of the intermediate section for receiving said projections.

9. A multi-sectional utensil holder as described in claim 8, in which the diameter of the open end of the top section is less than the diameter of the inner wall of the intermediate section, whereby when the top section is inverted and positioned in the opening formed by the inner wall of the intermediate section, the projections adjacent the lower edge of the side wall of the top section are received in the recesses which are adjacent the upper edge of the inner wall of the intermediate section.

10. A multi-sectional utensil holder as described in claim 8, in which the coupling means on the intermediate section includes slots adjacent to and in communication with the recesses for receiving the projections of the top section when the top section is positioned on top of the intermediate section with the projections in the recesses and partially rotated relative thereto.

* * * * *